US010723586B2

(12) United States Patent
Studer et al.

(10) Patent No.: US 10,723,586 B2
(45) Date of Patent: Jul. 28, 2020

(54) METHOD FOR DRIVING A BRAKE DEVICE OF AN ELEVATOR SYSTEM

(71) Applicant: Inventio AG, Hergiswil (CH)

(72) Inventors: Christian Studer, Kriens (CH); Andrea Cambruzzi, Zürich (CH)

(73) Assignee: INVENTIO AG, Hergiswil NW (CH)

( * ) Notice: Subject to any disclaimer, the term of this patent is extended or adjusted under 35 U.S.C. 154(b) by 180 days.

(21) Appl. No.: 15/781,188

(22) PCT Filed: Nov. 18, 2016

(86) PCT No.: PCT/EP2016/078177

§ 371 (c)(1),
(2) Date: Jun. 4, 2018

(87) PCT Pub. No.: WO2017/093050

PCT Pub. Date: Jun. 8, 2017

(65) Prior Publication Data

US 2018/0362291 A1 Dec. 20, 2018

(30) Foreign Application Priority Data

Dec. 2, 2015 (EP) ..... 15197413

(51) Int. Cl.
*B66B 1/32* (2006.01)
*B66B 5/00* (2006.01)

(52) U.S. Cl.
CPC ..... *B66B 1/32* (2013.01); *B66B 5/0031* (2013.01)

(58) Field of Classification Search
CPC ..... B66B 1/32; B66B 5/0031
(Continued)

(56) References Cited

U.S. PATENT DOCUMENTS 4,034,856 A * 7/1977 Wehrli, III ..... B66B 1/32 187/288
4,101,013 A 7/1978 Duriez et al.
(Continued)

FOREIGN PATENT DOCUMENTS

CN 85103125 A 10/1986
CN 1217701 A 5/1999
(Continued)

*Primary Examiner* — Anthony J Salata
(74) *Attorney, Agent, or Firm* — William J. Clemens; Shumaker, Loop & Kendrick, LLP

(57) ABSTRACT

A method for driving an elevator car brake device, an elevator system for executing the method, and a computer program implementing the method involve the brake device including at least one automatically releasable pressure element effecting a braking action and an electromagnet automatically releasing the pressure element, wherein a respectively required braking torque of the car is ascertained using a model of the elevator system, a direction of car travel, a state of load of the car and a desired car deceleration. A drive signal for driving the electromagnet is generated based on the braking torque and is supplied to the electromagnet, wherein, when the car is braked, an actual car deceleration is ascertained and calibration is performed based on the ascertained actual car deceleration, specifically calibration of the ascertained required braking torque or calibration of the drive signal that is generated based on the ascertained required braking torque.

10 Claims, 5 Drawing Sheets

(58) Field of Classification Search
USPC ..... 187/247, 284, 287, 288, 291, 391, 393
See application file for complete search history.

(56) References Cited

U.S. PATENT DOCUMENTS 4,238,005 A * 12/1980 Watanabe ..... B66B 1/32 187/288
4,380,049 A * 4/1983 Makinen ..... B66B 1/44 187/291
4,629,034 A * 12/1986 Inaba ..... B66B 1/40 187/293
5,070,290 A * 12/1991 Iwasa ..... B66B 5/02 187/288
5,402,863 A * 4/1995 Okumura ..... B66B 1/32 187/288
5,969,303 A * 10/1999 Piserchia ..... B66B 1/28 187/288
7,658,268 B2 * 2/2010 Kinpara ..... B66B 1/308 187/293
9,469,504 B2 * 10/2016 Hopp ..... B66B 29/00
10,196,237 B2 * 2/2019 Kattainen ..... B66B 1/24
2010/0133046 A1 * 6/2010 Allwardt ..... B66B 7/08 187/251

FOREIGN PATENT DOCUMENTS

CN 101132980 A 2/2008
CN 102325713 A 1/2012
CN 103209918 A 7/2013
DE 2448851 A1 4/1976
EP 1870369 A1 12/2007
EP 2399858 A1 12/2011
GB 2153465 A 8/1985
JP 2004131207 A 4/2004
SU 604784 A1 4/1978
SU 615025 A1 7/1978
WO 0232800 A2 4/2002

* cited by examiner

20 DRIVE 22 BRAKE DEVICE
42 ELEVATOR SYSTEM MODEL
44 ELEVATOR CONTROL UNIT
46 BRAKE DEVICE MODEL
48 PULSE-WIDTH MODULATOR
50 CALIBRATOR

20 DRIVE 22 BRAKE DEVICE
42 ELEVATOR SYSTEM MODEL
44 ELEVATOR CONTROL UNIT
46 BRAKE DEVICE MODEL
48 PULSE-WIDTH MODULATOR
50 CALIBRATOR 51 COMPARATOR
52 ACTUATOR 54 DATABASE

METHOD FOR DRIVING A BRAKE DEVICE OF AN ELEVATOR SYSTEM

FIELD

The invention relates to a method for actuating a brake device for an elevator system, to an elevator system having means for executing the method, and to a computer program for implementing the method.

BACKGROUND

In this method, a brake device of an elevator system is actuated, which brake device is known in principle. The brake device comprises, for example, an electromagnetically disengageable spring-actuated brake and an electronically actuatable electromagnet for disengaging the spring-actuated brake. The braking action is achieved by means of the spring force of at least one spring. On account of the spring force, a pressure element of the spring-actuated brake, which pressure element has a brake lining, rests against a counter surface, for example on a brake disc of the elevator drive, at least when the electromagnets are de-energized. The pressure element can be a pressure plate that can be pressed against the brake disc, or it can be a pressure shoe or brake shoe that can be pressed against a brake drum, for example. By actuating the electromagnet, the braking action can be canceled by the pressure element being lifted from the counter surface, against the action of spring force, by means of the electromagnet.

A brake device of this type, or a comparable brake device, of an elevator system is intended to hold an elevator car of the elevator system in a holding position. An elevator system comprising a plurality of elevator cars comprises an individual brake device for each elevator car. In the interests of improved readability, but without dispensing with further general validity, the following description will proceed using the example of an elevator system having precisely one elevator car which is movable in precisely one elevator shaft. Said elevator system should always be understood to mean an elevator system having a plurality of elevator cars in one shaft or even in a plurality of shafts.

In addition to holding the elevator car in a holding position, a brake device is necessary and designed in order to be able to safely brake the elevator car at any time during operation, that is to say even in the event of a fault situation. Possible fault situations are, for example, unexpected opening of a car door, an excessive travel velocity, loss of holding position, and so on.

When the brake device is activated, the activation often takes place in a manner that results in a maximum braking action. This leads to an intense deceleration that is unpleasant for the passengers in the elevator car. In order to prevent this, systems are known which control, in a closed-loop or open-loop manner, a particular effective braking torque.

JP 2004/131207 A discloses a brake device in which a plurality of electromagnets are actuated in each case by means of a pulse-width modulated actuation signal.

GB 2 153 465 A discloses load-dependent and travel-direction-dependent control of a brake device. EP 1 870 369 A contains explanations for determining mass parameters of an elevator system.

SUMMARY

An object of the invention consists in providing a brake device of the type mentioned at the outset, which effects efficient metering of a relevant expended braking torque over a long operational period of the elevator system and the brake device it comprises, in such a way that both a required deceleration of the elevator car is achieved and passengers in the elevator car are not disturbed by the forces acting during deceleration.

This object is achieved by a method for actuating a brake device, in particular a brake device of the type mentioned at the outset having at least one pressure element which is intended to effect the intended braking action, can be automatically released (disengaged) from a counter surface, and comprises a brake lining, in particular at least one electromagnetically disengageable spring-actuated brake having such an element. Furthermore, the brake device comprises means for automatically releasing the or each pressure element from the counter surface, for example by means of an electronically actuatable electromagnet.

The following is provided in the context of the method for actuating the brake device: A braking torque required for braking the elevator car is ascertained by means of a model of the elevator system by taking into account a respective operational state of the elevator system, such as a respective direction of travel of an elevator car of the elevator system to be braked, an automatically ascertained respective state of load of the elevator car, and a predetermined or predeterminable desired car deceleration.

For this purpose, the model of the elevator system contains a mass, reduced to the location of the brake device, of the moved elevator parts, such as the elevator car, permitted load capacity, counterweight, inertial masses of rotating rollers and drives, cable masses, taking into account take-up factors, gearings, and roller diameters and drive diameters. Furthermore, the model of the elevator system contains an empirical friction part that opposes a movement of the elevator parts. The braking torque required for braking the elevator car can be ascertained by means of these model variables and the previously already noted variables corresponding to the respective operational state of the elevator system.

In one embodiment, the model of the elevator system is already sufficiently precisely described just by providing a weight ratio of the permitted load capacity to car weight and by detailing a degree of counterbalancing. The degree of counterbalancing determines the proportion of load capacity in the elevator car which is required in order to produce a mass equilibrium between the counterweight side and the car side. A degree of counterbalancing of 50% determines, for example, that when the elevator car is loaded with half the permitted loading capacity, the mass equilibrium is produced. Therefore, generally, just by means of these few parameters and the respective operational state of the elevator system—direction of travel and current state of load of the elevator car to be braked—the braking torque required for braking the elevator car can thus be ascertained. The required braking torque should not be understood here as being an absolute indication of value; rather, the required braking torque can be a braking relationship. Depending on the size, overall mass, take-up factors and the type of elevator, an appropriately dimensioned brake device having an appropriate possible braking torque is required. The braking relationship thus substantially provides a braking torque factor, which is known as braking torque in the present context.

On the basis of the braking torque ascertained in this way, or the corresponding braking relationship, an actuation signal for actuating a device is generated and is supplied to the respective device, such that the elevator car is braked, which device functions as a means for automatically releasing the or each pressure element from the counter surface, i.e. for example an actuation signal for actuating the or each electromagnet. A mutual dependency between the braking torque and the actuation signal is stored in a braking characteristic of the brake device. This means that in the case of a required braking torque, the required actuation signal can be read from the braking characteristic. In the following, in accordance with conventional linguistic usage, the automatically releasable pressure element or even a plurality of such pressure elements, together with the counter surface, are referred to as a "brake" for short. If the device for releasing the brake is not actuated at all, this results in the maximum braking action. If the device for releasing the brake is actuated to its maximum, the brake is fully released and there is no braking action at all. Actuating the device for releasing the brake between these extremes allows metering of the braking action. In principle, the actuation signal generated on the basis of the ascertained braking torque effects the metering of the braking action according to the ascertained braking torque.

In order to ensure that the resulting braking action matches the previously empirically ascertained required braking torque (i.e. the braking characteristic) as well as possible, an actual car deceleration is ascertained during braking of the elevator system. On the basis of the ascertained actual car deceleration, calibration of the braking characteristic of the brake device is performed, specifically calibration of the ascertained required braking torque and/or calibration of the actuation signal which is generated on the basis of the ascertained required braking torque.

The actuation signal used for actuating the device for releasing the brake, or a corresponding control variable for actuating the electromagnetically disengageable spring-actuated brake, has a physically defined relationship with the resulting pressing force of the pressure element on the counter surface, and thus by taking into account a corresponding coefficient of brake friction with respect to the braking torque. This physically defined relationship determines the progression of the braking action between the extremes, whereby metering of the braking action is facilitated. This physically defined relationship is the basis of the braking characteristic. On the basis of the ascertained actual car deceleration, in a determined operational state of the elevator system, calibration of the brake device, or the braking characteristic of the brake device, is performed. The physically defined relationship, or the braking characteristic, is thus recalibrated on the basis of the actual car deceleration. If the actual car deceleration corresponds precisely with the desired car deceleration, the braking characteristic is not changed.

In one embodiment, the braking characteristic represents the expected braking torque as a function of the actuation signal. The expected braking torque of an electromagnetically disengageable spring-actuated brake can be found from a spring-force value and a magnetic-force value. The spring-force value contains the spring force effected by a spring and the magnetic-force value takes into account the counter force effected by the electromagnet. The counter force effected by the electromagnets is typically determined in quadratic dependence on a coil current of the electromagnet, and the actuation signal generally directly defines the coil current. Also taken into account in the spring-force value and the magnetic-force value are respective coefficients of friction, lever systems and, if necessary, other influencing variables, such as an air gap or a summation of a plurality of braking surfaces.

Calibrating the brake device, or the braking characteristic of the brake device, thus includes correction of the spring-force value and the magnetic-force value. The braking characteristic recalibrated by means of the corrected spring-force value and the corrected magnetic-force value thus reflects an actual braking behavior.

The approach proposed here is advantageous in that a predefined or predefinable desired car deceleration is incorporated in the method for actuating the brake device. The desired car deceleration is selected such that a required deceleration of the elevator car results and that passengers in the elevator car are not disturbed by the forces acting during deceleration. Keeping to these boundary conditions is referred to for short in the following as efficient metering of the braking torque. Furthermore, the approach proposed here is advantageous in that efficient metering of this type of a respectively expended braking torque is possible over a long operating period of the respective elevator system, theoretically during the entire service life of the elevator system. By ascertaining an actual car deceleration and by recalibrating the braking characteristic on the basis of the actual car deceleration, transient effects in the overall system of the elevator system or in the brake device, such as temperature differences or humidity differences and the accompanying effects on the braking process, as well as material wear in the elevator system and changing kinetic resistance and the like that correlate therewith, can be taken into account, and so, irrespective of such effects, a braking action that remains the same even over a long service life is achieved.

Calibration of this type is performed in such a way that, for example, in the case of an actual car deceleration that is only half as great compared to the desired car deceleration, calibration is performed which, in a subsequent braking process, leads to the ascertained required braking torque being doubled, or to corresponding adaptation of the actuation signal, for example adaptation of a pulse-width modulated actuation signal. Continuous calibration during operation of the elevator system effects the braking action that remains the same, even over a long service life, i.e. at least a period of several months or at least during a conventional service interval. On account of the efficient metering of the respective expended braking torque, the elevator system as a whole, the passengers traveling therewith, and the brake device and the materials that come into contact in order to achieve the braking action are protected.

In an advantageous embodiment of the method, the calibrated braking characteristic is evaluated in respect of tolerable limiting characteristics. In this case, the calibrated braking characteristics are approved for further use, if the calibrated braking characteristic is within the limits determined by the limiting characteristics. The calibration is performed automatically. The limiting characteristics indirectly specify the extent to which deviations between the actual car deceleration and the desired car deceleration are classified as being comparatively low and fundamentally tolerable deviations. Automatically performing the calibration in the event of such a low level of deviation, i.e. without operating staff or service staff having to intervene, results in continual automatic adaptation of the brake device to possible transient effects.

In another, additional, or alternative advantageous embodiment of the method, a warning message is output as soon as the calibrated braking characteristic goes beyond the limits determined by the limiting characteristics. The operating staff or service staff thus receives notification of an existing or an imminent exceptional situation and can take suitable counter measures, for example they can check the brake lining of the pressure element and replace it if necessary, they can check the counter surface and replace it if necessary, and/or they can check the spring, or the like, which acts on the pressure element and replace it if necessary. The warning message can be output in the form of an optical and/or acoustic warning message and/or an electronic message by automatic activation of at least one corresponding actuator. The warning message can additionally or alternatively also be output such that the elevator system is automatically switched into an associated, predefined or predefinable operating mode. In the operating mode, the elevator car is moved only at a reduced speed, for example. Alternatively, the automatically activated operating mode may also consist in the elevator car being immovable until there has been an acknowledgement from operating staff or service staff.

In another embodiment of the method, a pulse-width modulated actuation signal is generated as the actuation signal on the basis of the calibrated required braking torque. A pulse-width modulated actuation signal is advantageous in that, when producing the circuitry of a pulse-width modulator using electronic switching elements, in particular bipolar or MOS transistors or IGBTs, these elements can function in a low-loss switching operation.

In yet another embodiment of the method, a predefined or predefinable number of braking processes and a respective calibration can be carried out in order to start up the elevator system and/or for one-time or regular adjustment of the brake device during an initialization phase of the brake device. A plurality of braking processes allow improved calibration of the brake device, in that, with every recalibration during the initialization phase, the respectively performed calibration brings the actual car deceleration increasingly well in line with the desired car deceleration. In an advantageous addition to this embodiment of the method, within the braking processes carried out during the initialization phase, at least one braking process is performed following an upward movement of the elevator car and at least one braking process is performed following a downward movement of the elevator car. An elevator engineer assigned the task of adjusting the elevator system therefore no longer has to manually carry out appropriate adjustment work; instead, the brake device calibrates itself automatically according to the method.

In another embodiment of the method, an expected braking period is calculated in each case on the basis of the desired car deceleration and, after the expected braking period has elapsed, the actuation signal is predefined such that the brake device generates a maximum braking torque. As a result, the elevator system is held at a standstill in a safe and energy-saving manner. In the brake device presented at the outset, this means, specifically, that the device for releasing the brake is not actuated at all; i.e. the actuation signal is set to zero. The maximum braking action results there-from. At the same time, this means that the electronically actuated electromagnet is switched without power.

Overall, the innovation proposed here is also an elevator system having at least one elevator car and a brake device intended for braking the elevator car, as well as means for executing the method described here and in the following. The means for executing the method preferably include at least the model of the elevator system and an elevator control unit. An implementation of the method is advantageously considered in the form of software or a combination of software and hardware. If the control program is executed by means of an elevator control unit of the respective elevator system, the innovation is also a computer program, which functions as a control program for the elevator system and comprises program code means, for carrying out all the steps of the method described here and in the following. In an implementation of the method, and optionally in individual embodiments of said method, the elevator control unit comprises a memory in which the control program is loaded, and also a processing unit in the form of or in the manner of a microprocessor, by means of which the control program can be executed. During operation of the elevator system and during operation of the elevator control unit, the method, or the method in an optional embodiment, is executed accordingly by executing the control program.

An embodiment of the invention will be described in greater detail in the following, with reference to the drawings. Items or elements that correspond to one another are provided with the same reference signs in all of the drawings. The embodiment should not be understood as restricting the invention. Rather, within the scope of the present disclosure, numerous modifications are possible, in particular those variants, elements and combinations which, for example, can be inferred by a person skilled in the art with respect to solving the problem, by combining or modifying individual features, elements, or method steps, which are described in conjunction with the general or specific part of the description and are contained in the claims and/or the drawings, and lead to a new subject matter or new method steps or method step sequences through combinable features, and also if they relate to testing and working methods.

DETAILED DESCRIPTION

Figure 1:
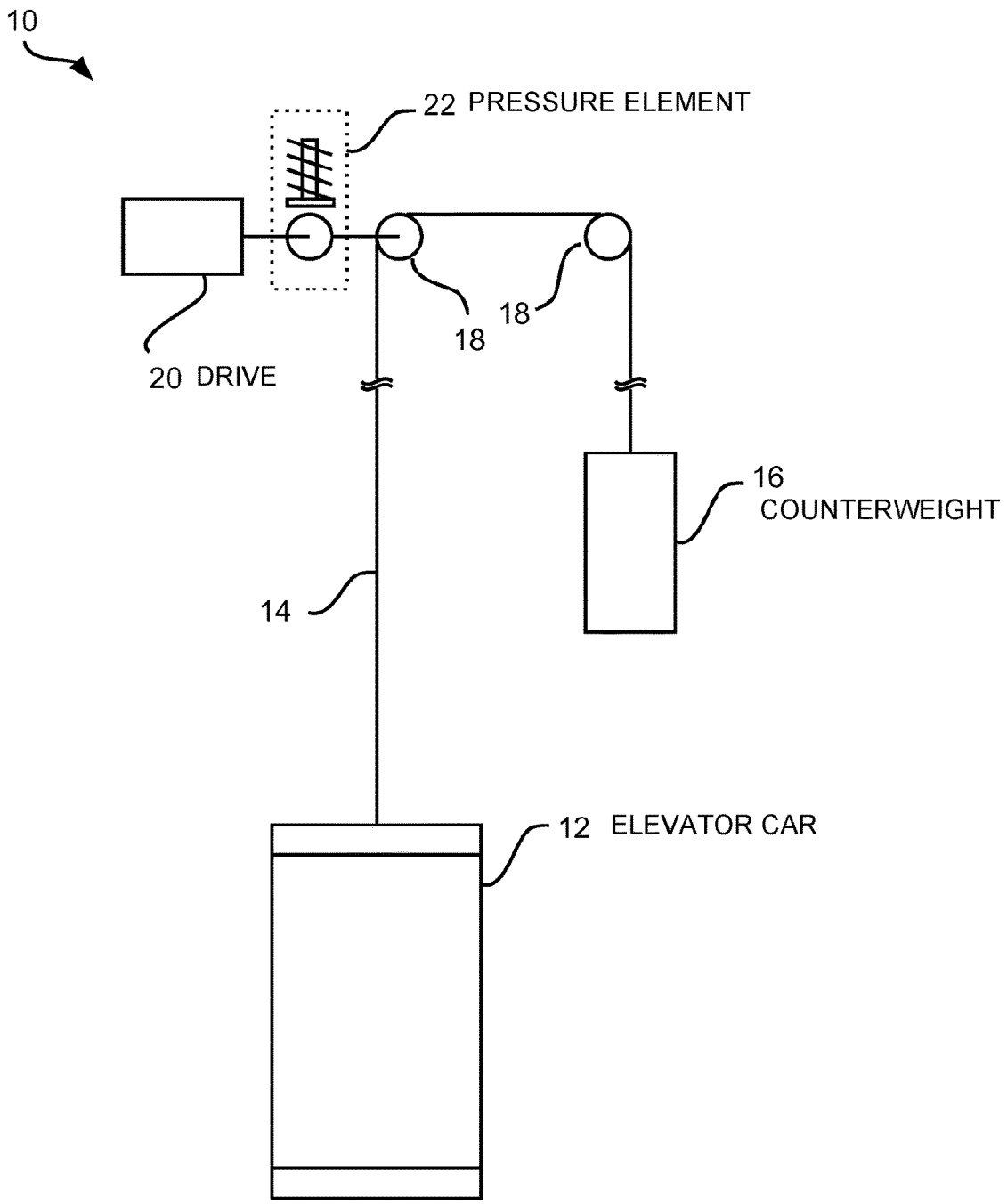
Fig. 1 (Prior Art)
FIG. 1 shows an elevator system comprising an elevator car and a brake device for braking the elevator car according to the prior art.

The view in FIG. 1 shows in a schematic and highly simplified manner an elevator system 10 of a type known per se, comprising an elevator car 12, a suspension cable 14 for moving the elevator car 12 and a counterweight 16 on the end of the suspension cable 14 opposite the elevator car 12. The suspension cable 14 is guided over at least one cable sheave 18. The cable sheave 18, or at least one of the cable sheaves 18, is driven by means of an electric motor that functions as a drive 20. In order to brake the elevator car 12 during operation of the elevator system 10, at least one brake device 22 is provided.

The specific type of brake device 22 is not essential to the invention. The approach proposed here can be applied to any type of brake device 22, provided these types are automatically releasable. The drawing in FIG. 1 shows the brake device 22 in a schematically simplified manner, in a form that is known, for example, from GB 2 153 465 A. The brake device 22—as shown in greater detail in the enlarged view in FIG. 2—accordingly comprises an automatically releasable pressure element 24 which is intended to effect a braking action. In order to achieve the braking action, the pressure element 24 is pressed against a counter surface 26 which moves relative to the pressure element 24 during movement of the elevator car 12. The counter surface 26 can, for example, be a peripheral surface or a lateral surface of a brake disc 28 which is driven, together with the driven sheave 18, by a drive 20, or a surface of a guide rail (not shown), which surface functions as a brake path.

Figure 2:
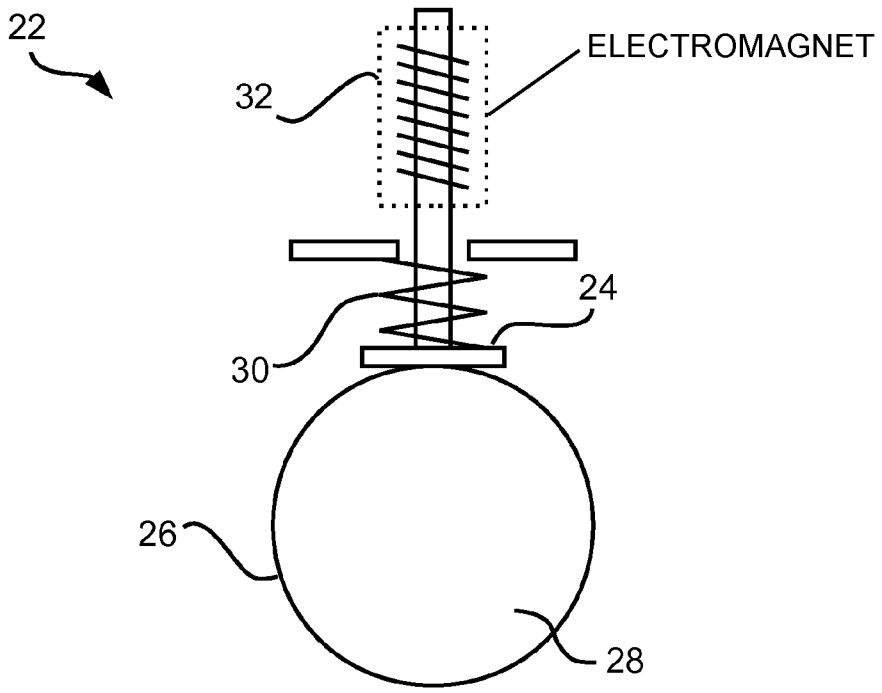
Fig. 2 (Prior Art)
FIG. 2 shows a possible embodiment of a brake device according to the prior art.

In the configuration shown in FIG. 2, the pressure element 24 rests on the peripheral surface of the shown brake disc 28, which peripheral surface functions as the counter surface 26, such that the brake device 22 deploys the provided braking action. The brake device 22 is passively effective. This means that the braking action is always provided without an external influence canceling said braking action. This is achieved by means of a spring 30 in the embodiment shown in FIG. 2. The spring 30 is braced between a brace and the pressure element 24, and the pressure element 24 therefore rests against the counter surface 26 on account of the spring force of the spring 30. In the embodiment shown in FIG. 2, an electromagnet 32 functions as means for automatically releasing the pressure element 24 and thus as means for automatically canceling the braking action. Said electromagnet comprises, in a known manner, a coil, through which current flows when activated, and a ferromagnetic core. A piston, which carries the pressure element 24 on the end thereof, functions here as the ferromagnetic core.

The strength of a magnetic field that results from a flow of current through the coil determines the force that acts in each case, by means of which force the pressure element 24 is raised or pulled away from the counter surface 26 against the spring force of the spring 30. When the electromagnet 32 is actuated to a maximum, the braking action disappears; by contrast, the braking action is at its maximum when the electromagnet 32 is not actuated at all. Actuating the electromagnet 32, which functions as a device for releasing the brake, between these extremes therefore allows the braking action to be metered and the respective actuating action thus defines the strength of the braking action of the brake device 22 and, accordingly, the braking torque applied by means of said brake device 22. Spring-actuated brakes in the form of disc brakes are often used here. Here, the counter surface 26 is defined by a brake disc that rotates together with a drive of the elevator. The pressure element 24 is provided with a brake lining that can interact with the counter surface 26. The pressure element 24 is raised or pulled away from the counter surface 26, against the spring force of the spring 30, by means of the electromagnet 32. A brake clearance between the brake lining of the pressure element 24 and the counter surface 26 is minimal here when the electromagnet 32 pulls the pressure element 24. The brake clearance is in the range of from almost zero up to a few tenths of a millimeter. The influence of an air gap in the magnetic circuit is thus negligible. In addition, an impact noise when the brake device closes is minimized since the brake lining almost rests against the counter surface.

On the basis of the drawing in FIG. 3, the ascertainment of a respectively required braking torque M and the generation of an actuation signal 40 for actuating the device for releasing the brake (in the embodiment shown, this is the generation of an actuation signal 40 for actuating the electromagnet 32) will be explained in the following: The respectively required braking torque M is ascertained by means of a model 42 of the elevator system 10. In order to ascertain the braking torque M, the model 42 takes into account a respective direction of travel R of the elevator car 12 and a current state of load m of the elevator car 12. The model 42 receives electronically processable values for these two parameters R, m from an elevator control unit 44 (the model 42 can also be realized as individual functionality of the elevator control unit 44). As a further specification, the model 42 processes an input value that encodes a desired car deceleration Vs. This can also be transmitted to the model 42 by the elevator control unit 44. However, the parameters can also be input as external parameters and thus supplied directly to the model 42. The desired car deceleration Vs is selected and adjusted such that there is a required deceleration of the elevator car 12 and passengers in the elevator car 12 are not disturbed by the forces acting during deceleration.

The model 42 functions as a system model of the elevator system 10 and includes a mathematical description of the dynamics of the elevator system 10. The model 42 takes into account an elevator mass, a permitted car load capacity, a degree of counterbalance, possible gearing factors and, optionally, a coefficient of friction of the system. The elevator mass comprises inertial masses of the drive 20, of pulleys 18 and of linearly moved masses such as cables 14, counterweight 16 and car 12. The permitted car load capacity corresponds to the permitted maximum load of the elevator car 12. The degree of counterbalance determines the proportion of permitted load capacity in the elevator car 12, so as to achieve a static equilibrium state of the elevator system 10 (counterweight side and car side). The coefficient of friction of the system determines a level of resistance that counteracts a movement of the elevator car 12 as a result of friction. These system-specific data can be determined in various ways. For example, said data can be predetermined in the factory. Alternatively, said data can also be learned by the elevator system, for example in a manner as described in EP 1 870 369 A1.

In the embodiment shown, the required braking torque M ascertained by means of the model 42 is supplied to the elevator control unit 44. The subsequent processing of the ascertained braking torque M can, in principle, also take place outside the elevator control unit 44, and includes implementation of conventional functions of the elevator control unit 44 that are not taken into account and, accordingly, are not described here, for example also in the context of the model 42 or in a brake control unit. Of course, the model 42 can, in principle, also be realized as individual functionality of the elevator control unit 44. For the rest of the description, the configuration shown by way of example is assumed.

Within the elevator control unit 44, or, where applicable, a corresponding brake control unit, the ascertained required braking torque M is processed by means of a functional unit that can be considered to be an additional model. The functional unit includes an implementation of the braking characteristic of the brake device 22 and is therefore referred to in the following as a brake device model 46, in order to distinguish it from the model 42 of the elevator system 10. The ascertained required braking torque M is converted by means of the brake device model 46 into a manipulated-variable value of a manipulated variable, which manipulated-variable value is required in order to obtain said braking torque. The relationship between the manipulated variable and the braking torque M, which is a theoretical relationship, or, in other words, the braking characteristic of the brake device, is stored in the brake device model 46. This can take place by means of a table (look-up table) stored as an implementation of the brake device model 46, or by means of a mathematical relation stored as an implementation.

In a brake device 22 that comprises an electromagnet 32 as means for releasing the brake, the manipulated variable is the coil current, which is applied to the electromagnet 32.

The manipulated-variable value is the amplitude of the coil current I or the pulse-duty factor in an electromagnet 32 to which a pulse-width modulated coil current is applied. The table or the mathematical relation of the brake device model 46 takes into account the spring force of the spring 30 and the electromagnetic force that results in the case of a respective manipulated-variable value and counteracts the spring force. In another type of brake device and a different manner of releasing the brake, there is a different manipulated variable and, accordingly, a different manipulated-variable value. However, the principle remains the same. Processes for actuating the electromagnet 32 by means of a pulse-width modulated (PWM) coil current are tried and tested. Of course, other types of actuation processes, such as phase angle control or reverse phase control, are also known for influencing the strength of a magnetic field.

Figure 3:
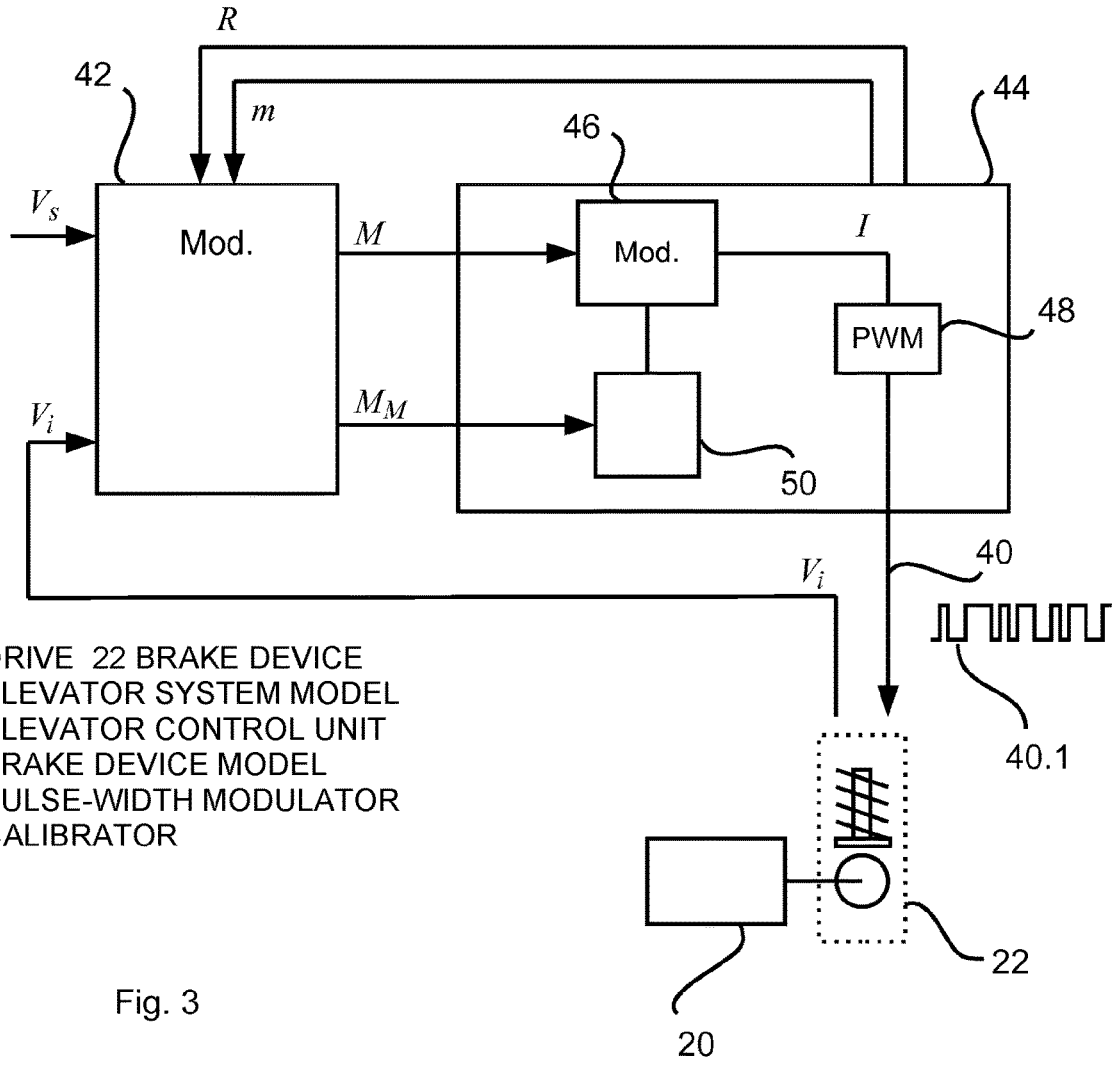
FIG. 3 is a drawing to illustrate an implementation of the approach proposed here for actuating a brake device according to the invention.

The view in FIG. 3 shows a configuration in which a coil current I is ascertained by means of the brake device model 46 on the basis of the previously ascertained required braking torque M as a manipulated-variable value, which coil current is subsequently converted into a pulse-width modulated actuation signal 40.1 by means of a pulse-width modulator 48. The actuation signal 40 is shown in FIG. 3 both symbolically as a square-wave signal or as a pulse-width modulated actuation signal 40.1 and as the actuation signal 40 conveyed to the brake device 22.

Actuating the brake device 22 using the actuation signal 40 generated in this way results in a determined actual braking action and a resulting actual car deceleration Vi. These can be measured by means of an acceleration sensor or by means of an incremental sensor or a different position-measuring system, such as by means of an encoded displacement sensor, on the basis of which a position of the elevator car 12 can be determined, or can be at least indirectly measured. When the elevator system 10 is braked, that is to say when the elevator car 12 is braked by means of the brake device 22, the respective actual car deceleration Vi is ascertained. When determining the actual car deceleration Vi, zones having a discontinuous deceleration curve, which occur, for example, at the beginning of the braking process, are not taken into account. Therefore, in order to determine the actual car deceleration Vi, only a reliable region is used. If unexpected variations are observed during the braking process, if necessary the measurement is not used further. Unexpected variations can be effected, for example, by a fault or discontinuousness in a guide system. If the actual car deceleration Vi is ascertained in this way, an actual braking torque $M_M$ is calculated on the basis of this actual car deceleration Vi and by using the model 42. This actual braking torque $M_M$ thus determines a working point or a test point of a braking characteristic. On the basis of this working point or test point, the braking characteristic stored in the brake device model 46 is calibrated in a calibrator 50 or recalibrated. A calibration curve of this type is explained in more detail in conjunction with FIG. 5.

Figure 4:
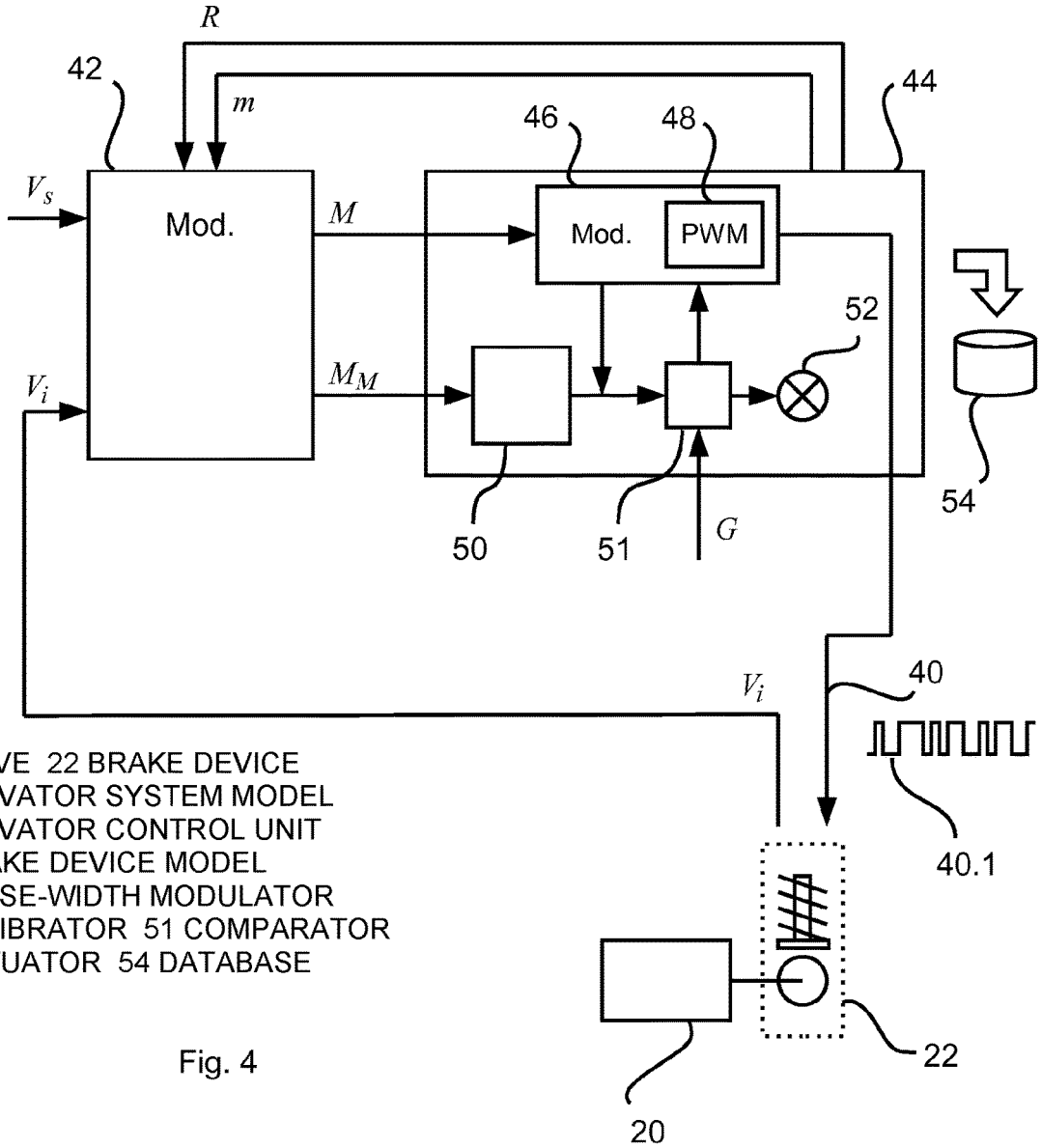
FIG. 4 shows an alternative implementation option.

In the drawing in FIG. 4, which substantially repeats the details shown in FIG. 3, the pulse-width modulator 48 is an individual functionality of the brake device model 46, and therefore said brake device model comprises a table or mathematical relation, on the basis of which an ascertained required braking torque M, which is supplied to the brake device model 46 at the input side, is converted into a duty factor of a pulse-width modulated actuation signal 40.1 for actuating the brake device 22. In such a configuration, the calibration is also performed on the basis of the ascertained actual car deceleration Vi and the actual braking torque $M_M$ ascertained therefrom.

The view in FIG. 4 additionally indicates that the recalibrated braking characteristic (see graph K3 in FIG. 5) that is determined from the actual braking torque $M_M$ is compared with at least one limiting value G by means of a comparator 51. The limiting values G are, as explained in the following description with respect to FIG. 5, actually limiting characteristics K2', K2", which determine upper and lower limiting values that cannot be exceeded by or be less than the recalibrated braking characteristic K3. The limiting characteristics K2', K2" are selected such that if they are exceeded, this indicates an exceptional situation. In a case of this kind, at least one actuator 52, shown in FIG. 4 in the form of an optical display element, is actuated, by means of which actuator operating staff or service staff for the elevator system 10 are alerted to the exceptional situation. Other actuators, for example an actuator for emitting an acoustic warning signal, or an actuator that triggers the sending of a warning message in the form of an email, SMS or the like, are, of course, also considered as an alternative or in addition. If the comparator 51 establishes that the recalibrated braking characteristic K3 remains within the limits determined by the limiting characteristics K2', K2", said recalibrated braking characteristic K3 is stored in the brake device model 46 and is approved for use in future braking processes.

Finally, FIG. 4 also shows a database 54, by means of which the variables that are used and/or result during operation of the elevator system 10 and when the brake device 22 is actuated can be logged for the purposes of archiving. At least the actual car deceleration Vi, the corresponding above-described parameters, and the calibration resulting therefrom are logged.

Figure 5:
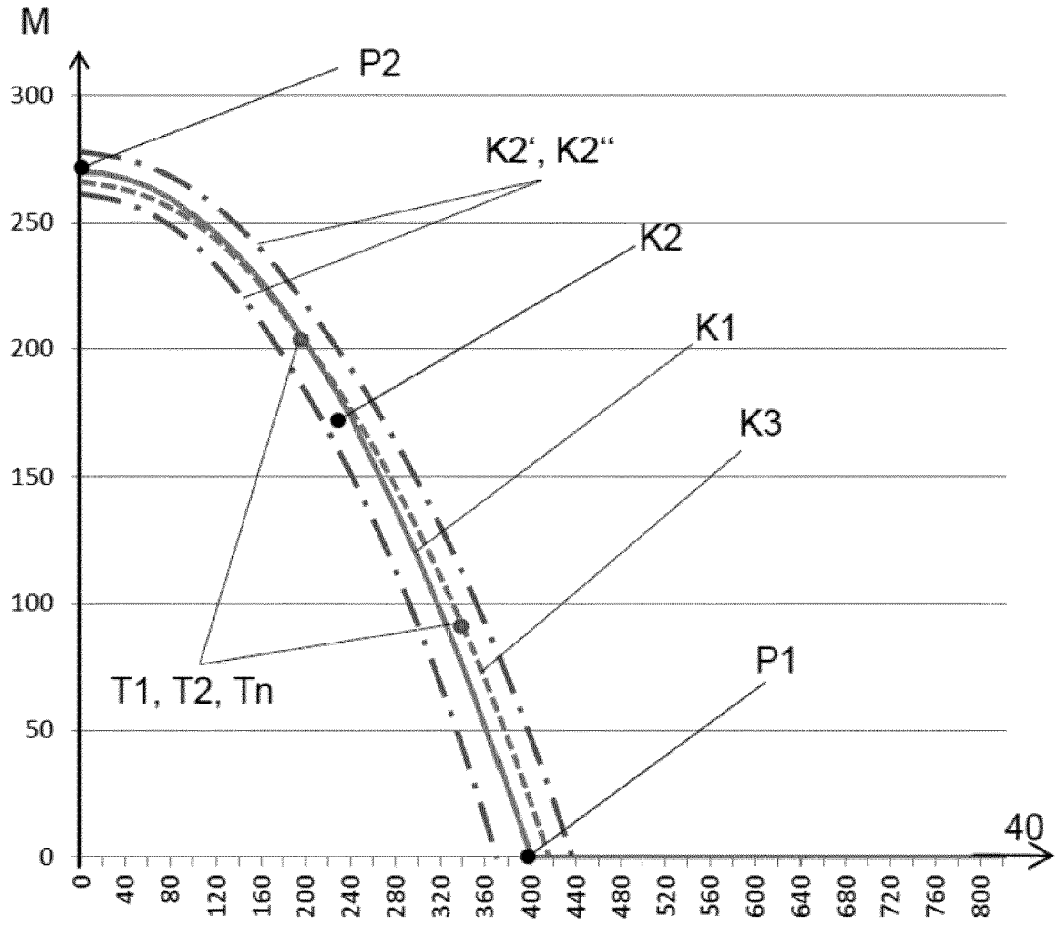
FIG. 5 is a graph of a calibration process.

FIG. 5 is a schematic view of a possible calibration process of the actuation signal 40. The brake device model 46 comprises a theoretical relationship, shown by graph K1, of the braking torque M effected by the brake device 22, as a function of the actuation signal 40. In this context, the braking torque M should also be understood as a braking relation. The scaling shown in FIG. 5 is not an absolute indication of value but instead, pertaining to the braking torque M, it is magnitude information in relation to the effective braking torque, and, pertaining to the actuation signal 40, is magnitude information in relation to the coil current I. The theoretical relationship between the actuation signal 40 and the resulting braking torque M can be shown by a parametric function. An intersection of graph K1 with the zero line of the braking torque M results in what is known as the closing point P1 of the brake device 22. If the actuation signal 40 goes beyond this closing point P1, the electromagnet lifts the pressure element 24 away from the counter surface and a resulting braking torque M is canceled or becomes zero. However, if the actuation signal 40 is reduced and does not meet the closing point P1, the brake device 22 is in the control range in which a braking torque M ensues that corresponds to the actuation signal 40. If the actuation signal 40 reaches the value of zero, the electromagnet is switched off. The intersection of graph K1 with the zero line of the actuation signal 40 results therefrom. This intersection can be referred to as the operating point P2 of the brake device 22. Therefore, in the operating point P2, the spring force of the spring 30 alone determines the braking torque M.

The braking characteristic, or also the theoretical relationship between the actuation signal 40 and the resulting braking torque M, represented by the graph K1, can thus be shown as follows:

braking torque $M$=spring force value $FF$-(magnetic force value $FM$×actuation signal 40 squared)

$$M \triangleq FF-(FM \times I^2)$$

Here the spring force value FF is a portion of braking torque effected by the spring force of the spring 30, the magnetic force value FM is a portion of braking torque which can be effected by the electromagnet on the basis of the control signal 40, and the control signal 40 is the signal corresponding to the coil current I.

Taking into account expected deviations in the elevator system, such as frictional influences, mass inaccuracies, and tolerances of the components used, the theoretical relationship is based on a tolerance range K2. The tolerance range is delimited in FIG. 5 by tolerance graphs K2', K2". The tolerance graphs K2', K2" define the limiting values G and/or the tolerable limiting characteristics K2', K2". Actuating the brake device 22 using an actuation signal 40, which is defined on the basis of the theoretical relationship K1, results in a determined actual braking action and a resulting actual car deceleration Vi, from which the actual braking torque can be calculated by means of the model 42 of the elevator system 10. New monitoring points T1, T2, Tn arise during each subsequent braking process. On the basis of these subsequent monitoring points T1, T2, Tn, a calibrated braking characteristic K3 is generated using the theoretical relationship, on which the graph K1 is based. Here, the calibrated braking characteristic K3 can, for example, be ascertained using a standard mathematical method for adjustment computation, which method is referred to as a least-squares method. In this case, the calibrated braking characteristic K3 which passes as close as possible to the data points is sought using the data points, which are predetermined by the theoretical relationship and are shown in graph K1, and using the monitoring points T1, T2, Tn, which are also logged. Provided this calibrated braking characteristic K3 is within the tolerance range K2 determined by the limiting characteristics K2', K2", further braking processes are carried out using the calibrated braking characteristic K3. The accuracy of the car deceleration that is performed can thus be improved with every additional braking process.

Each subsequent monitoring point T1, T2 can be provided with a weighting. This means that the monitoring points picked up during operation can be reduced in relation to the theoretically predetermined braking characteristic, and so changes in the braking characteristic or corresponding calibrations change only gradually. If the calibrated braking characteristic K3 goes beyond the tolerance range K2, a person skilled in the art is required to assess the braking system and appropriate warning messages are emitted. A multi-stage alert system can be used here. In a first stage, a person skilled in the art can be informed, in a second stage a service can be requested and in an additional stage an elevator system can be brought to a standstill.

The approach for actuating a brake device 22 of an elevator system 10, which approach is described in the introductory part of the description and is described in further detail on the basis of the drawings in FIGS. 3, 4 and 5, is, for example, implemented in software and is executed during operation of the elevator system 10 by executing a control program containing an implementation of the method proposed here. In this respect, the functional details shown in FIGS. 3 and 4 and explained here represent appropriate software functionality of the control program, for example software functionality that functions as a model 42 of the elevator system 10, software functionality that functions as a brake device model 46 and a routine that functions as a calibrator 51 and is realized in software, which routine is used in the example for calibrating the ascertained required braking torque $M_M$, such that the recalibrated braking characteristic K3 can be supplied to the brake device model 46.

Although the invention has been further illustrated and described in detail by the embodiment, the invention is not limited by the disclosed example(s), and other variations can be derived there-from by a person skilled in the art without going beyond the scope of the invention.

In accordance with the provisions of the patent statutes, the present invention has been described in what is considered to represent its preferred embodiment. However, it should be noted that the invention can be practiced otherwise than as specifically illustrated and described without departing from its spirit or scope.

The invention claimed is:

1. A method for actuating a brake device of an elevator system, wherein the brake device includes at least one automatically releasable pressure element that effects a braking action and a means for automatically releasing the pressure element, comprising the steps of:

ascertaining a required braking torque of an elevator car of the elevator system using a model of the elevator system, a direction of travel of the car, a state of load of the car and a desired car deceleration;

generating an actuation signal for actuating the brake device to release the pressure element based on the ascertained required braking torque and supplying the actuation signal to the brake device;

ascertaining an actual car deceleration when the elevator system is braked by the brake device; and calibrating a braking characteristic of the brake device based on the ascertained actual car deceleration, the braking characteristic being the ascertained required braking torque or the actuation signal that is generated based on the ascertained required braking force.

2. The method according to claim 1 including evaluating the calibrated braking characteristic in relation to tolerable limiting characteristics, and approving the calibrated braking characteristic for further use if the calibrated braking characteristic is within a limit defined by the limiting characteristics.

3. The method according to claim 2 including outputting a warning message as soon as the calibrated braking characteristic goes beyond the limit determined by the limiting characteristics.

4. The method according to claim 1 including, proceeding from the required braking torque, generating the actuation signal as a pulse-width modulated signal based on the calibrated braking characteristic.

5. The method according to claim 1 including carrying out, during an initialization phase of the brake device, a predefined or predefinable number of braking processes and respective calibration of the braking characteristic.

6. The method according to claim 1 including calculating an expected braking period based on the desired car deceleration, and predefining the actuation signal such that the brake device generates a maximum braking torque after the expected braking period has elapsed.

7. An elevator system comprising:

at least one elevator car;

a brake device for braking the at least one elevator car;

a model of the elevator system; and an elevator control unit for executing the method for actuating the brake device according to claim 1.

8. The elevator system according to claim 7 wherein the brake device includes at least one electromagnetically disengageable spring-actuated brake and an electronically actuatable electromagnet for disengaging the spring-actuated brake.

9. The elevator system according to claim 7 including a computer program product having program code means for performing the method for actuating the brake device when the program code means is loaded into a memory of the elevator control unit and is executed by the elevator control unit.

10. A computer program product having program code means for performing the method according to claim 1 when the program code means is loaded into and executed by an elevator control unit of the elevator system.

* * * * *